United States Patent [19]

Bauer

[11] Patent Number: 4,854,341

[45] Date of Patent: Aug. 8, 1989

[54] PLATE VALVE

[75] Inventor: Friedrich Bauer, Vienna, Austria

[73] Assignee: ENFO Grundlagenforschungs AG, Döttingen, Switzerland

[21] Appl. No.: 213,158

[22] Filed: Jun. 29, 1988

[30] Foreign Application Priority Data

Jul. 1, 1987 [AT] Austria ..... 1656/87

[51] Int. Cl.[4] ..... F16K 15/08

[52] U.S. Cl. ..... 137/514; 137/516.13; 137/516.21

[58] Field of Search ..... 137/514, 516.11–516.23

[56] References Cited

U.S. PATENT DOCUMENTS

| | | | |
|---|---|---|---|
| T946,012 | 5/1976 | Willis | 137/516.17 |
| 955,018 | 4/1910 | Twiggs | 137/516.17 |
| 1,695,069 | 12/1928 | Tuttle | 137/516.13 |
| 2,870,783 | 1/1959 | Kehler | 137/516.13 |

FOREIGN PATENT DOCUMENTS

| | | | |
|---|---|---|---|
| 722156 | 7/1942 | Fed. Rep. of Germany | 137/516.13 |
| 532178 | 1/1941 | United Kingdom | 137/516.13 |

*Primary Examiner*—Robert G. Nilson

*Attorney, Agent, or Firm*—Watson, Cole, Grindle & Watson

[57] ABSTRACT

A compressor plate valve has a valve seat (1) with flow passages (6), a valve guard and a valve plate (7) formed from concentric rings (16, 17) joined together by radial webs (18). In order to damp the valve plate (7), and in particular to lessen its impact both on opening and on closing the valve, and to reduce troublesome adhesion between the plates, the valve plate (10) comprises a closure plate (14) of soft material such as plastics, and a guide plate (15) of hard material such as steel. The two plates have the same outline in plan view and lie firmly against each other, the soft closure plate (14) facing the valve seat (1) and the guide plate (15) facing the valve guard (2). Only the outer ring (16) of the two plates (14, 15) is loaded by springs (13) and is substantially wider than the inner rings (17).

9 Claims, 1 Drawing Sheet

FIG. 1
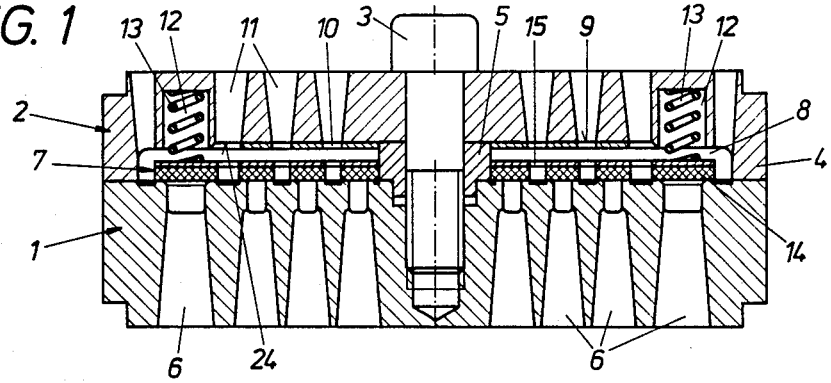
FIG. 3
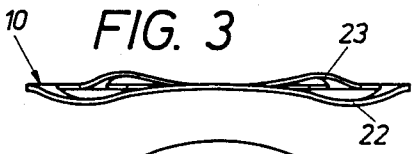
FIG. 2
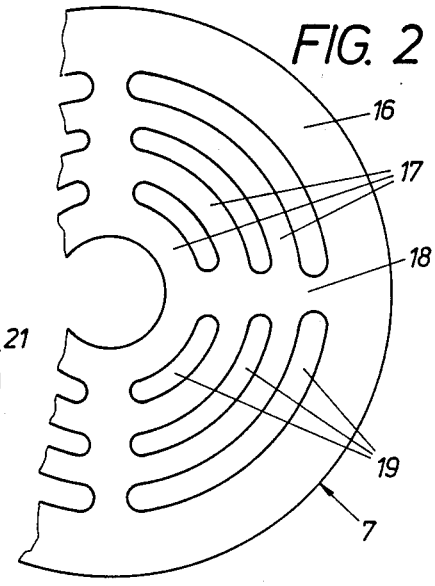
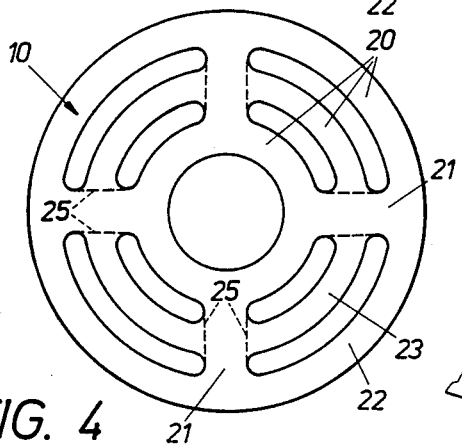
FIG. 4
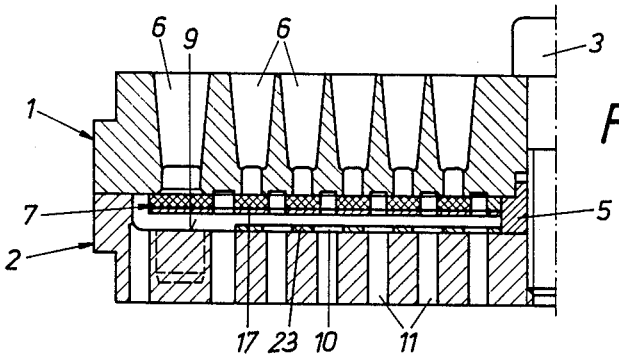
FIG. 5

PLATE VALVE

SUMMARY OF THE INVENTION

The invention relates to a compressor plate valve, comprising a valve seat, a valve guard and a valve plate which consists of an outer ring and at least one inner ring and controls flow passages in the valve seat, the rings being joined together by radial webs, and for the valve plate a spring system comprising springs disposed over the outer ring and supported against the valve guard, and acting only on the outer ring.

Plate valves of this kind are known in various forms. The plates interposed between the valve seat and valve guard move with the compressor cycle and impinge upon the valve guard and valve seat at relatively high speeds, and are thus subjected to high stresses. The highest stresses occur in the valve plate itself, which in many cases because of non-uniform oncoming flow performs a tumbling movement through the controlled medium, so that it is its outer edge which firstly impinges against the valve guard or valve seat.

It is known to reduce the valve plate impact on opening the valve by interposing damper plates between the valve plate and valve guard. This expedient alone is however never sufficient. For example, in the case of oil-lubricated compressors an oil film forms on the plates and this causes the plates to adhere to each other and to the valve guard. Consequently, the start of closure of the valve plate is retarded, resulting in increased impact of the valve plate against the valve seat on closing the valve. Moreover, the retarded closure of the valves decreases the compressor output.

U.S. Pat. No. 3,703,912 describes a valve comprising a damper plate which extends only over the inner rings of the valve plate. The outer ring of the valve plate is therefore less stressed as it does not impinge against the damper plate and is therefore able to deflect freely so that its impact against the valve guard is lessened. In addition, by this construction, the adhesion between the valve plate and damper plate is reduced, because not only is the contact surface smaller but the at least partially free-lying outer ring of the valve plate is embraced by the flow and can be dragged by it. In this manner, the stress in the valve plate during its closure is redued and the life of the overall compressor valve extended.

The object of the invention is to further improve compressor plate valves of this kind by still further reducing the impact of the valve plate, known to be the most highly stressed component, both on opening and on closing the valve, so that the life of the plate valve and its operational reliability are correspondingly increased.

The invention is based on the initially described plate valve and consists of a combination of several expedients. It is characterised in that the valve plate is composed of a closure plate of soft material such as plastics, and a guide plate of hard flexible material such as steel, the two plates lying one on the other with the closure plate facing the valve seat and the guide plate facing the valve guard, and in that the outer ring of both plates, this alone being loaded by the springs, is wider than the inner rings. The combination of these expedients in a compressor plate valve results in a series of advantages compared with the known constructions, and substantially obviates their drawbacks.

The closure plate constructed of soft material, preferably plastics, ensures trouble-free sealing and also reduces the impact of the valve plate against the valve seat. At the same time, the guide plate of hard material such as steel supports the soft closure plate and gives it the necessary rigidity and stability. It also facilitates uniform transmission of the spring force onto the individual rings of the closure plate. The wide outer ring strengthens the valve plate in its most highly stressed region and at the same time provides the necessary room for the springs. In addition, concentrating the springs onto the outer edge of the valve plate improves its parallel movement during its lifting motion, so that the tendency to tumble is substantially eliminated.

In a preferred embodiment of the invention, a damper plate is inserted loosely between the valve guard and the guide plate and extends only over the region occupied by the inner rings of the guide plate and of the associated closure plate. Although the damper plate is not actually fixed or fastened within the valve, it lessens the impact of the valve plate against the valve guard and facilitates the release of the valve plate from the valve guard during closure movement. The damping action is particularly advantageous if the damper plate consists of concentric rings joined together by radial webs, and if at least one ring portion between two adjacent radial webs is arched out of the plane of the plate. This provides additional springy reaction against the valve plate during its opening movement.

According to a further embodiment of the invention, if at least some of the ring portions of the damper plate are narrower than the valve plate rings and/or the rings of the valve guard impact surface which are axially aligned therewith, the surface area of mutual contact of the neighbouring plates with the valve open is correspondingly reduced. This also reduces the adhesion between the mutually contacting surfaces so that even if an oil film exists on the surfaces, any disadvantageous adhesion resulting in late closure of the valve is prevented. The same advantages can be obtained, or indeed augmented by combined use of the expedients, if some of the ring portions of the damper plate are removed from it and the webs in the removed region extended as far as the next ring. The reduction in the contact surface area is thus obtained by the elimination of one or more rings of the damper plate.

According to a further embodiment of the invention, at least two ring portions are arched in different directions out of the plane of the damper plate. Thus results in increased spring action and its almost uniform distribution over the damper plate surface. In this case the total thickness of the damper plate when its arched ring portions are in their unstressed state should be smaller than the free clearance available in the damper plate region between the valve guard and guide plate. The spring force generated on the damper plate by the arched ring portions then acts only during the opening movement of the valve plate to result in impact damping, while at the same time preventing any increase in the closure force itself, which would result in late commencement of the opening movement.

The valve guard can comprise a flat impact surface against which the damper plate lies when the valve is open. At the outer edge of the damper plate a step then forms with the result that the outer ring of the valve plate has available a stroke which is greater by the thickness of the damper plate and is able somewhat to die down before its impact against the valve guard.

According to the invention, it is also advantageous to provide in the impact surface of the valve guard facing the damper plate a recess for accomodating the damper plate when the valve is open. This embodiment is particularly advantageous if the damper plate is comparatively thick and comprises arched ring portions which react with spring force against the valve plate. The depth of the recess in the contact surface of the valve guard is desirably smaller than the thickness of the damper plate when in its unstressed state.

The flow of the controlled medium through the valve can be improved according to the invention by making the free slits between the outer ring and the adjacent inner ring of both the closure plate and guide plate wider than the remaining slits between the inner rings. This expedient takes account of the greater width of the outer ring and adjusts the available flow passage areas of the individual slits to the flow rate in the respective surface region.

Embodiments of the invention are described hereinafter with reference to the drawing, in which:

FIG. 1 is an axial middle section through a first embodiment of a compressor plate valve according to the invention;

FIG. 2 is a partial plan view of the valve plate;

FIG. 3 is a side view and FIG. 4 a plan view of the damper plate; and

FIG. 5 is an axial middle section through a further embodiment of the plate valve according to the invention, but showing only the left half of the valve.

The plate valve comprises a valve seat 1 and a valve guard 2 which is fixed onto the valve seat 1 by a screw 3. The valve guard 2 lies by its outer edge 4 on the valve seat 1, a spacer ring 5 being disposed in the centre between the valve seat 1 and the valve guard 2. Flow passages 6 for the medium controlled by the plate valve are hollowed out of the valve seat 1 and are controlled by a valve plate 7. The valve plate 7 lies in an intermediate compartment 8 between the valve seat 1 and the valve guard 2 and moves with its inner edge along the outer surface of the spacer ring 5. On that side of the valve guard 2 facing the valve plate 7 there is an impact surface 9 against which a damper plate 10 lies. Discharge openings for the controlled medium are provided in the valve guard. Recesses 12, known as spring nests, are distributed concentrically about the valve axis in the valve guard 2, to hold spiral springs 13 which act against the valve plate 7 in the closure direction.

From FIG. 1 it can be seen that the valve plate 1 comprises a closure plate 14 and a guide plate 15. The closure plate 14 faces the valve seat 1, is constructed of softer material than the guide plate 15, such as a plastics, and controls the flow passages 6 of the valve seat 1. The guide plate 15, constructed of harder material such as steel, faces the valve guard 2, its purpose being to support and stabilise the closure plate 14 of less firm material. In addition, the guide plate 15 distributes the spring force exerted by the springs 13 on the valve plate 7 over the entire surface of the valve plate 7.

The closure plate 14 and guide plate 15 have the same outline in plan view and lie against each other. If need be they can be joined together at individual points or over their entire surface, eg. cemented together. From FIG. 2 it can be seen that the closure plate 14 and the guide plate 15 making up the valve plate 7 each comprises an outer ring 16 and several inner rings 17, which are joined together by radial webs 18. Between the individual rings 16, 17 there are slits 19 for the passage of the controlled medium. The outer ring of the closure plate 14 and guide plate 15 is substantially wider than the inner rings 17. The slits 19 between the outer ring 16 and the adjacent inner ring 17 are also wider than the remaining slits 19 between the inner rings 17.

FIGS. 3 and 4 show the damper plate 10. This also comprises concentric rings 20 joined together by radial webs 21. Certain ring portions between the webs 21 are arched out of the plane of the plate. From FIG. 3 it can be seen that the ring portions 22 of the outer ring 20 are arched downwards and the ring portions 23 of the middle ring 20 are arched upwards. The inner ring 20 is flat. The arching of the ring portions 22 and 23 in shown somewhat magnified in FIG. 3. The scope of the invention also covers any other deformation of the damper plate 10 which would provide spring action of the damper plate 10 in a determined region. As can be seen from FIG. 4, the ring portions 23 are narrower than the ring portions 22 and also narrower than the inner ring 20 of the damper plate 10. In particular, the ring portions 23 are also narrower than the plate rings 17 of the valve plate 7 and of the impact surface 9 of the valve guard 2 which cooperate with them. By this means, the impact surface between the valve plate 7 and damper plate 10 is decreased, so reducing the adhesion between the two plates which arises from the stickiness which exists if an oil film is present between the two plates 7 and 10 and valve guard 2. In FIG. 4 the dashed lines 25 show how the radial webs 21 can extend between the outer and inner rings 20 of the damper plate 10, so dispensing with the middle ring 20 comprising the ring portions 23. This embodiment also results in reduction of the impact surface between the damper plate 10 and valve guard 2 or valve plate 7, so that the two plates are able to easily separate from the impact surface 9 of the valve guard 2 and from each other on closure of the valve. In addition, all rings 20 of the damper plate 10 can be narrower than the rings of the valve plate 7 or valve guard 2.

The total thickness of the damper plate 10 with arched ring portions 22, 23 is smaller, when in its non-stressed state, than the clearance which exists in the region of the damper plate 10 between the valve guard 2 and the guide plate 15 in the intermediate compartment indicated by 8 in FIG. 1. The damper plate 10 is loosely inserted between the valve guard 2 and the guide plate 15 so that it rests, when the valve is closed, against the valve plate 7 and accompanies it in its movements. It can also be seen that the damper plate 10 extends in the radial direction only over the inner rings 17 of the valve plate 7, the wider outer ring 16 only being loaded by the springs 13. It is however also possible to fix the damper plate 10 in the valve or to provide it with its own guide means, such as flexible linkages. By the action of the springs 13 distributed over the circumference of the valve plate 7, stabilisation and good parallel travel of the valve plate 7 during its lifting movement is obtained. The tendency of the valve plate 7 to tumble and the troublesome oblique impact of the plate edge against the valve seat 1 or valve guard 2 are substantially prevented.

In the embodiment shown in FIG. 1 a recess 24 for the damper plate 10 is provided in the impact surface 9 of the valve guard 2. This enables the damper plate 10 to be completely or partly received in the valve guard 2. The embodiment shown in FIG. 5 differs in that the impact surface 9 of the valve guard 2 is flat, and the damper plate 10 therefore forms a small step in the region of the outer ring 16 of the valve plate 7. By this means, the outer ring 16 can undergo a somewhat longer stroke than the inner rings 17, with the result that its impact against the valve guard 2 is damped. Again in the embodiment of FIG. 5 the valve plate 7 comprises a closure plate 14 and a guide plate 15, the outer ring 16 being wider than the inner rings 17. The slit 19 between the outer ring 16 and the inner rings 17 is also wider than the remaining slits 19 between the inner rings 17, so that the discharge openings 11 in this region of the valve guard 2 are somewhat wider than in the central region of the plate valve.

Also, as shown in FIG. 5 ring segments 23 of damper plate 10 are made narrower than rings 17 of valve plate 7 which are axially aligned therewith. Ring segments 23 of plate 10 are also narrower than the rings of impact surface 9 of guard 2, the damper plate 10 lying on such impact surface 9.

What is claimed is:

1. A compressor plate valve, comprising a valve seat, a valve guard and a valve plate which comprises an outer ring and at least one inner ring and controls flow passages in the valve seat, the rings being joined together by radial webs, and for the valve plate a spring system comprising springs disposed over the outer ring and supported against the valve guard, and acting only on the outer ring, wherein the valve plate (7) comprises a closure plate (14) of soft material such as plastics, and a guide plate (15) of hard flexible material such as steel, the two plates (14, 15) lying one on the other with the closure plate (14) facing the valve seat (1) and the guide plate (15) facing the valve guard (2), and wherein the outer ring (16) of both plates (14, 15), this alone being loaded by the springs (13), is wider than the inner rings (17).

2. A plate valve as claimed in claim 1, wherein a damper plate (10) is loosely disposed between the valve guard (2) and the guide plate (15) and extends only over the region occupied by the inner rings (17) of the guide plate (15) and of the associated closure plate (14).

3. A plate valve as claimed in claim 2, wherein the damper plate (10) comprises concentric rings (20) joined together by radial webs (21), at least one ring portion (22, 23) between two adjacent radial webs (21) being arched out of the plane of the plate.

4. A plate valve as claimed in claim 3, wherein at least some of the ring portions (23) of the damper plate (10) are narrower than the rings (17) of the valve plate (7) and/or the rings of the impact surface (9) of the valve guard (2) which are axially aligned therewith.

5. A plate valve as claimed in claim 3, wherein at least two ring portions (22, 23) are arched in different directions out of the plane of the damper plate (10).

6. A plate valve as claimed in claim 3, wherein the total thickness of the damper plate (10) when its arched ring portions (22, 23) are in their unstressed state is smaller than the free clearance available in the region occupied by the damper plate (10) between the valve guard (2) and guide plate (15).

7. A plate valve as claimed in claim 1, wherein in the impact surface (9) of the valve guard (2) facing the damper plate a recess (24) is provided for accomodating the damper plate (10) when the valve is open.

8. A plate valve as claimed in claim 7, wherein the depth of the recess (24) in the impact surface (9) of the valve guard (2) is smaller than the thickness of the damper plate (10) when in its unstressed state.

9. A plate valve as claimed in claim 1 wherein the slits (19) between the outer ring (16) and the adjacent inner ring (17) of both the closure plate (14) and the guide plate (15) are wider than the remaining slits (19) between the inner rings (17).

* * * * *